US005592802A

United States Patent [19]

Malin et al.

[11] Patent Number: 5,592,802

[45] Date of Patent: Jan. 14, 1997

[54] TRANSVERSE ZIPPER SYSTEM

[75] Inventors: Art Malin, Northbrook; Donald Van Erden, Wildwood; Michael McMahon, Palatine, all of Ill.

[73] Assignee: Illinois Tool Works, Inc., Glenview, Ill.

[21] Appl. No.: 647,580

[22] Filed: May 13, 1996

Related U.S. Application Data

[62] Division of Ser. No. 393,864, Feb. 24, 1995.

[51] Int. Cl.[6] ..... B65B 61/20

[52] U.S. Cl. ..... 53/133.4; 53/139.2; 53/550

[58] Field of Search ..... 53/133.4, 139.2, 53/412, 550, 551, 568; 493/214, 927

[56] References Cited

U.S. PATENT DOCUMENTS

| | | | |
|---|---|---|---|
| Re. 34,905 | 4/1995 | Ausnit | 53/133.4 |
| 4,617,683 | 10/1986 | Christoff | 53/139.2 |
| 4,896,775 | 1/1990 | Boeckmann et al. | 53/412 |
| 5,096,516 | 3/1992 | McDonald et al. | 493/214 |
| 5,127,208 | 7/1992 | Custer et al. | 53/133.4 |
| 5,425,216 | 6/1995 | Ausnit | 53/410 |

*Primary Examiner*—John Sipos
*Assistant Examiner*—Gene L. Kim
*Attorney, Agent, or Firm*—Kane, Dalsimer, Sullivan, Kurucz, Levy, Eisele, and Richard, LLP

[57] ABSTRACT

Packages being produced on a form, fill and seal machine as provided with transverse zippers inserted thereinto through a fin seal gap. Pairs of fin sealing bars are separated by a gap to produce the fin seal gap. The fin seal gap is opened, perhaps by vacuum means, and a zipper probe inserts a zipper having a web into the tube of plastic sheet material being formed into bags. The web of the zipper is sealed to the plastic sheet material, and the zipper probe withdrawn from the tube. Cross seal jaws seal both transverse ends of the package, a knife separates each package from that previously made, and a fin gap sealer seals the fin seal gap to complete the manufacture.

8 Claims, 7 Drawing Sheets

TRANSVERSE ZIPPER SYSTEM

This is a division of copending application Ser. No. 08/393,864, filed Feb. 24, 1995.

BACKGROUND OF THE INVENTION

1. Field of The Invention

The present invention relates to the manufacture of plastic bags or packages on a form, fill and seal (FFS) machine, particularly a vertical form, fill and seal (VFFS) machine, from a sheet of thermoplastic material, wherein each plastic bag or package includes a reclosable plastic zipper comprising a pair of mutually interlocking zipper profiles. More specifically, the present invention comprises a method and an apparatus for continuously and sequentially forming such bags or packages having such zippers disposed in a direction transverse to that of the filling tube of the FFS machine, and, consequently transverse to the direction in which the thermoplastic sheet progresses on the FFS machine during the production of the bags or packages. Further, the present invention comprises a reclosable plastic zipper which is particularly adapted to the practice of the invention.

2. Description of the Prior Art

The present invention relates to improvements in the package-making art and may be practiced in the manufacture of thermoplastic bags and packages of the kind that may be used for' various consumer products, but which are particularly useful for food products which must be kept in moisture- and air-tight packages, free from leakage until initially opened for access to the product contents, which packages are then reclosable by zipper means to protect any remainder of the product therein.

The indicated art is fairly well-developed, but nevertheless remains susceptible to improvement contributing to increased efficiency and cost effectiveness.

One problem that still hampers the production of packages from continuous zipper-equipped sheet material is the difficulty in attaining a satisfactory sealing of the bag or package against leakage, where the zipper and area of film engaged by the zipper extends through the side (cross) seal areas separating one bag or package from the next. This problem occurs where the zipper is longitudinal with respect to the filling tube on the FFS machine, in which case the transverse, or side, sealing bars must flatten and seal the zipper at the same time as they are sealing the thermoplastic sheet material from which the packages are being made. The difficulty .with which this is consistently and successfully achieved is reflected by the high occurrence of leaking packages.

Numerous attempts have been made to solve this problem. Among the approaches that have been taken is the substitution of a transverse zipper for the longitudinal zipper. Where such a zipper is provided, the transverse sealing bars associated with the FFS machine do not flatten the zipper as they are making the side seal, although they may seal the zipper to the thermoplastic sheet material without flattening it.

Several prior art patents are illustrative of such attempts. U.S. Pat. No. 4,878,987 to Van Erden shows a method and an apparatus for forming film capable of being converted into bags in a form, fill and seal machine or for providing bags attached to each other in end-to-end relationship including relatively advancing a continuous sheet of thin plastic film along a path having a fastener station therealong, moving first and second thermoplastic flexible fastener members laterally from opposite sides of the sheet to extend transversely substantially to the center thereof and attaching said fastener members to the surface of the sheet whereby the sheet can thereafter be formed into bags in a form, fill and seal machine or folded longitudinally to join the fastener members and to form a side seal to form a completed series of bags by cross-seaming the material at predetermined spaced intervals.

U.S. Pat. No. 4,909,017 to McMahon et al. shows a method of making a form-fill bag having a reclosable fastener thereon and a mechanism therefor wherein a continuous length of film is advanced and joined first and second fastener profile strips are laid laterally onto the film of a length substantially equal to one-half of the film width, the film is advanced and formed into a tube with the side edges folded together and seamed, the first profile strip is attached to the surface of the film prior to forming it into the tube and the second opposed interlocked profile strip is attached to the inner surface of the film after it is formed into a tube, and a cross-seam is formed in the tube above the closure strip to form the bottom of the succeeding bag and a completed bag is cut from the film by cutting below the bottom seam and above the fastener strips.

In both of these prior-art patents, the .zipper profile or profiles is applied to thermoplastic sheet material before the material is introduced onto the form, fill and seal machine. As a consequence, the practice of these disclosed inventions has been hampered by an increase in sheet-handling problems brought about by the periodic disposition of the zipper profile or profiles thereon. To wit, the zipper profile or profiles has made it more difficult to smoothly wrap the sheet material about the filling tube of the FFS machine during the production of bags or packages. As such, these two prior-art inventions have not provided an acceptable solution to the side seal problem.

Another approach is shown in U.S. Pat. No. 5,111,643 to Hobock. This patent shows a fastener strip, with interlocking profiles of resilient material for purposes of enabling one to reclose a plastic bag after its initial opening, is secured to the bag as the bag is being formed over a cylindrical forming tube. To accomplish this, a continuous carrier strip to which the fastener strip material is mounted is passed into the interior of the forming tube to a port in the tube wall, the strip thereby passing to the outer surface of the tube where it travels part way around the tube circumference, reentering the tube interior through a second port. Between the ports, the carrier strip exposes the fastener strip mounted to it to the web from which the bag is being formed, and the fastener strip is heat fused to the web. A specially constructed combination strip which combines the carrier strip and the fastener strip material allows the two to readily separate once the fastener strip material is bonded to the web. This arrangement permits the fastener strip material to be applied to the bag web after the two interlocking halves of the fastener strip material have been joined.

It will be readily apparent that this procedure is quite awkward and complex. Unfortunately, it, too, has not provided an acceptable and workable solution to the side seal problem.

On the other hand, the present invention, to be described hereinbelow, affords a practical method and apparatus for manufacturing plastic bags and packages with transverse zipper on a FFS machine.

SUMMARY OF THE INVENTION

Accordingly, the present invention is firstly a method for manufacturing plastic bags or packages on a form, fill and seal machine comprising the step of directing a sheet of plastic sheet material having lateral edges toward and about a filling tube of the form, fill and seal machine to form a tube thereabout having a fin formed by the lateral edges. The fin is sealed except for a fin seal gap, and the tube is flattened below the bottom of the filling tube. The fin seal gap is then opened and a zipper probe inserted therethrough to dispose a zipper having a web within the tube. The web of the zipper is then sealed to the plastic sheet material of the tube, and the plastic sheet material is sealed adjacent to the web to seal an end of the bag or package. Further, the plastic sheet material is sealed to seal another end of the package. The zipper probe is withdrawn through the fin seal gap and the fin seal gap is sealed to complete the manufacture of a package according to the method. Alternately the probe could be placed in the tube at a location other than the fin seal gap by slitting or puncturing the tube and resealing the same after the probe is withdrawn.

The present invention is also an apparatus for use in practicing the method. The apparatus includes a first pair of fin sealing bars and a second pair of fin sealing bars, the first and second pairs being separated by a gap, so that a fin seal gap will be provided at intervals equal to the longitudinal dimension of the bags or packages being produced.

The apparatus also includes means for opening the fin seal gap at a first position downstream from the gap between the first and second pairs of fin sealing bars a distance equal to a whole number multiple of the longitudinal dimension of the bags or packages. The means for opening the fin seal gap may be a vacuum means.

Also at the first position is a means for inserting a preselected length of zipper having a web into the tube of plastic sheet material. The means for inserting may be a zipper probe.

Further, at the first position is a pair of longitudinally moveable cross seal jaws for sealing the web of the zipper to the tube, for sealing an end of the package adjacent to the zipper, and for sealing an end of a previously manufactured package. A knife may be included within the cross seal jaws for separating a package from one previously manufactured.

Means are also provided for moving the cross seal jaws longitudinally from the first position to a second position downstream a distance equal to a longitudinal dimension of a bag or package as the tube is being advanced, during which time the fin gap sealer located adjacent to or on the cross seal jaws engage to seal the fin seal gap upon withdrawal of the zipper probe and while the cross seal jaws travel between the first and the second positions. A fin gap sealer is located at the second position for sealing the fin seal gap. Finally, means are provided for returning the cross seal jaws to the first position.

Lastly, the present invention includes a zipper particularly adapted to the practice thereof by including guiding rails which ride in grooves in the zipper probe used to insert the zipper transversely across the tube. The zipper comprises male and female zipper profiles. The male zipper profile has a male interlocking member, a web extending laterally from the male interlocking member, and at least one zipper guiding rail extending therefrom behind and in a direction opposite to that of the male interlocking member.

The female zipper profile has a female interlocking member adapted for snapping engagement with the male interlocking member, a web extending laterally from the female interlocking member in the same direction as that in which the web extends laterally from the male interlocking member, and at least one zipper guiding rail extending therefrom behind and in a direction opposite to that of the female interlocking member.

The present invention will now be described in more complete detail with frequent reference being made to the several drawing figures identified below.

DETAILED DESCRIPTION OF THE PREFERRED EMBODIMENT

Figure 1:
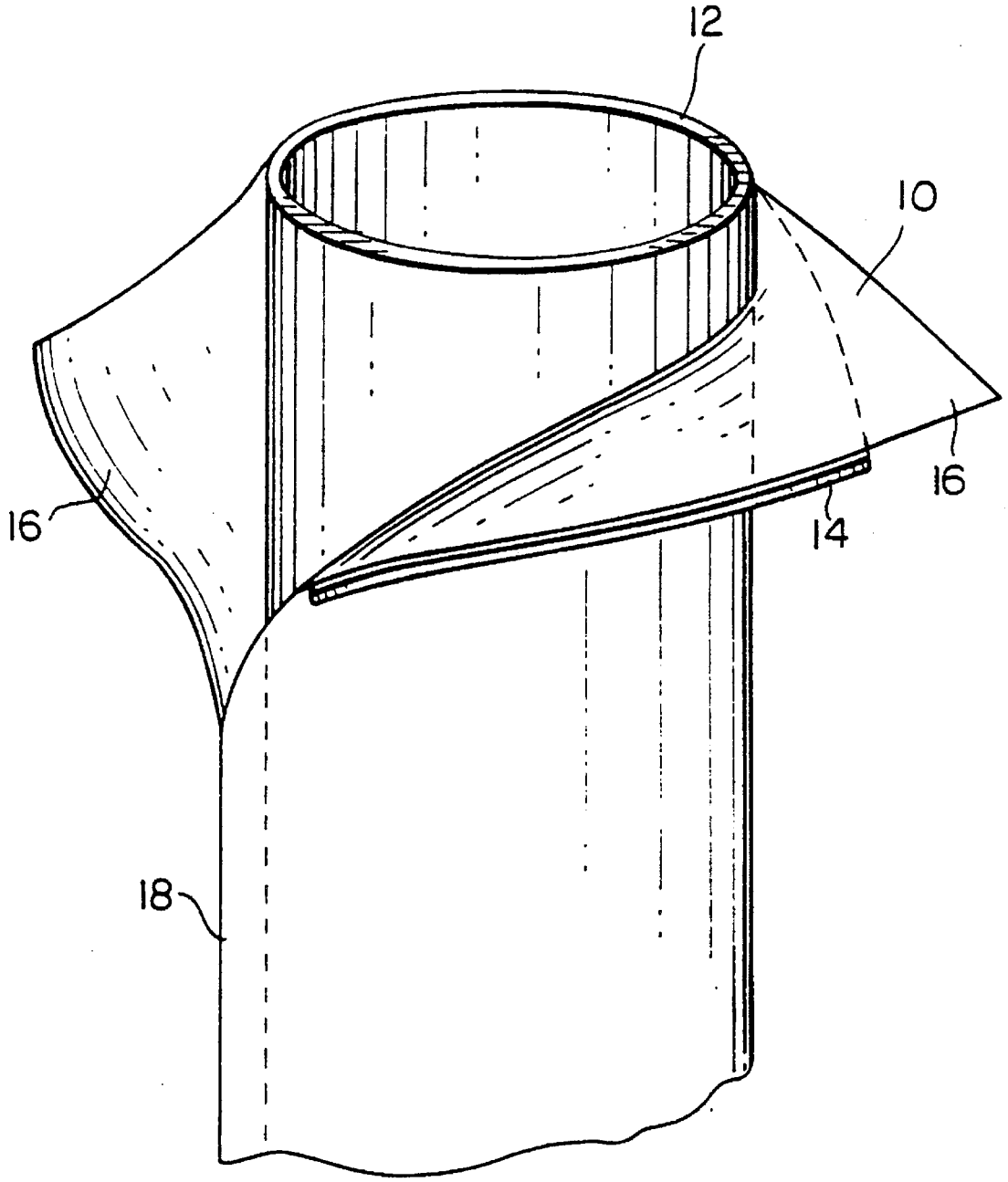
FIG. 1 is a perspective view of a filling tube of a VFFS machine.

Referring now to FIG. 1, plastic sheet material 10 is directed toward a filling tube 12 and associated forming collar 14, which guides the plastic sheet material 10 around the filling tube 12 to form a tube from the plastic sheet material 10. The filling tube 12 may, for example, be that of a conventional vertical form, fill and seal (VFFS) machine, which is so-called because the filling tube 12 is oriented in a substantially vertical direction, permitting the material intended to be the contents of the plastic bags or packages being produced to simply fall in preselected amounts thereinto. The lateral edges 16 of the plastic sheet material 10 are brought together to form fin 18, which forms the longitudinal side of the plastic bags or packages being manufactured in accordance with the present invention, where the word "longitudinal" implies that the fin 18 is aligned with the filling tube 12.

Figure 2:
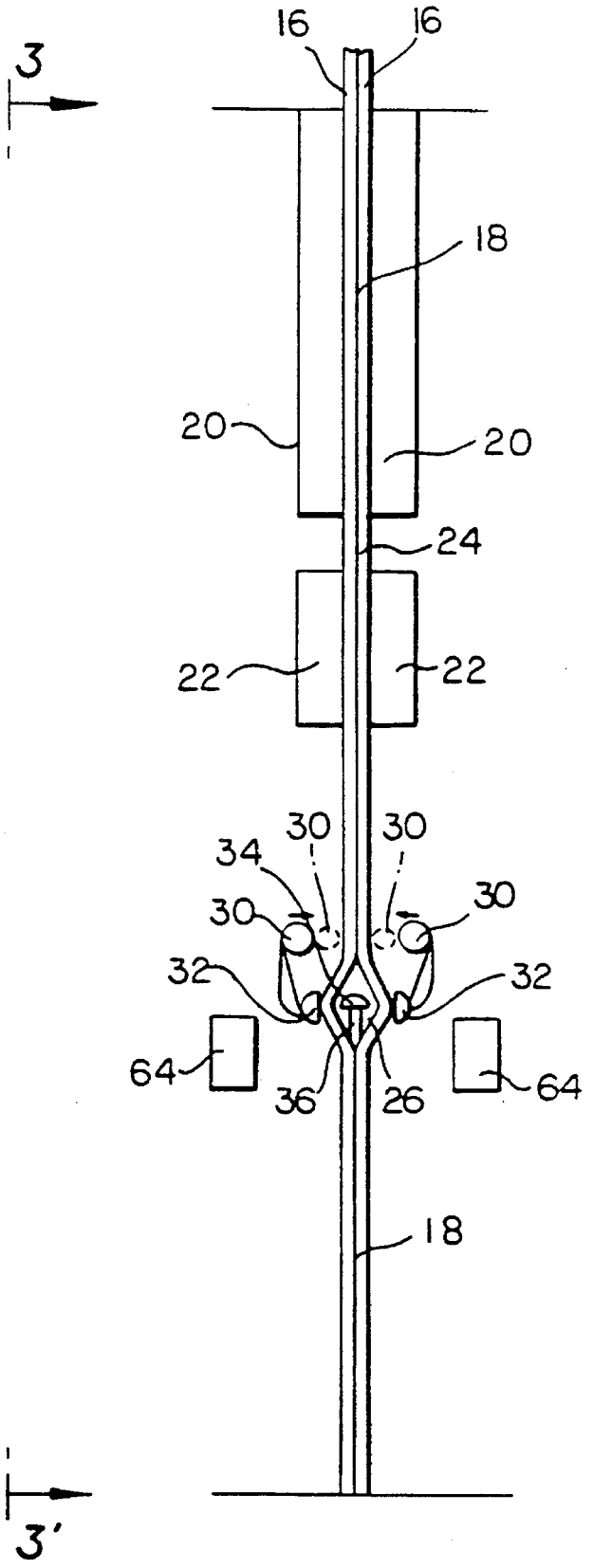
FIG. 2 is an edgewise view of a fin formed by the lateral edges of a plastic sheet material on the filling tube according to the present invention

Referring to FIG. 2, which is an edgewise view of the fin 18 on the filling tube 12, the fin 18 is sealed by fin sealing bars 20,22. Between fin sealing bars 20 and fin sealing bars 22 is a gap 24 in which fin 18 is not sealed. The provision of gap 24 provides a periodic fin seal gap 26 in the tube of plastic sheet material 10 being formed. Each fin seal gap 26 is separated longitudinally from the next by a distance equal to the longitudinal dimension of the plastic bags or packages being manufactured.

Figure 3:
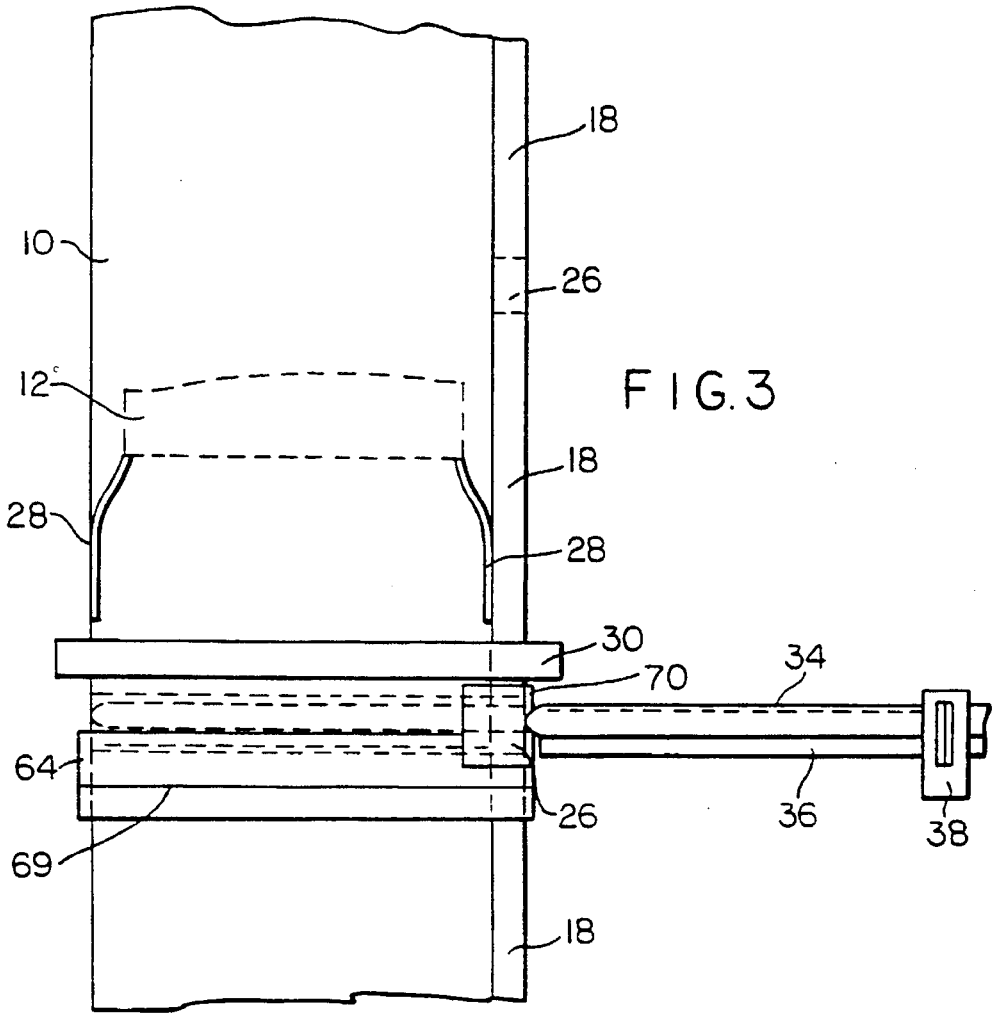
FIG. 3 is a side view of the fin taken as indicated by line 3—3' in FIG. 2.

FIG. 3 is a side view of the fin 18 taken as indicated by line 3—3' in FIG. 2. For clarity, fin sealing bars 20,22 are not included. Fin 18 should be understood to be sealed, however, except for fin seal gap 26.

It should be understood, especially by those having an ordinary level of skill in the relevant arts, that the plastic sheet material 10, having been formed into a tube around filling tube 12, proceeds therealong sequentially in increments equal in length to the longitudinal dimension of the plastic bags or packages. After each incremental length of the fin 18 is sealed by fin sealing bars 20,22 with the production of a fin seal gap 26, it proceeds downward past the bottom of the filling tube 12 and past a pair of spreader bars 28, one of which is within the tube of plastic sheet material 10 at the location of the fin 18, the other of which is in a diametrically opposed position. Spreader bars 28 flatten the tube of plastic sheet material 10 in such a manner that the fin 18 runs along one lengthwise edge of the flattened tube.

Referring again to FIGS. 2 and 3, below the spreader bars 28 are stagers 30 to which are operatively connected means for opening fin seal gap 26. Such means may be vacuum cups 32, which may be connected to a source of vacuum of an amount sufficient to spread fin seal gap 26 apart as shown in FIG. 2.

When fin seal gap 26 is so opened, a zipper probe 34 having a preselected length of zipper 36 comprising interlocked male and female zipper profiles is inserted through the opened fin seal gap 26. Preferably, the zipper probe 34 may be fed with a continuous supply of zipper 36 from which the preselected length is cut by a zipper cutting guillotine 38.

Stagers 30 close onto plastic sheet material 10 above fin seal gap 26 after the fin seal gap 26 has been opened, as suggested by the arrows in FIG. 2, to permit the product drop cycle to begin while zipper 36 is being inserted through the opened fin seal gap 26.

Figure 4:
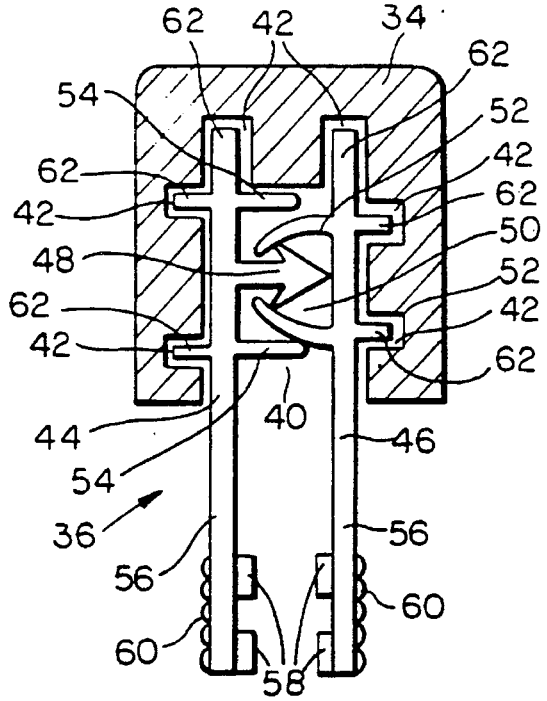
FIG. 4 is a transverse cross section through the zipper probe and zipper used in the practice of the present invention.

A transverse cross section of the zipper probe 34 and zipper 36 is provided in FIG. 4. Zipper probe 34 is substantially U-shaped in cross section and has several grooves 42 within an inverted U-shaped channel 40. Preferably, two such grooves 42 may be on each side of inverted U-shaped channel 40 while two may be on the roof of inverted U-shaped channel 40. The grooves 42 are provided to guide zipper 36 by cooperating with zipper guiding rails which may be an integral part thereof.

More specifically, zipper 36 comprises interlocked male and female zipper profiles 44,46. The male zipper profile 44 includes a male interlocking member 48, while the female zipper profile 46 includes a female interlocking member 50, perhaps formed by inwardly curving ribs 52, adapted to snappingly receive the male interlocking member 48. The male zipper profile 44 may also include guide ribs 54, one on each side of the male interlocking member 48 and separated therefrom by an amount sufficient to ensure that inwardly curving ribs 52 of female interlocking member 50 are readily guided about male interlocking member 48.

The male and female zipper profiles 44,46 also each include a web 56 which extends out of the U-shaped channel 40 of the zipper probe 34. The mutually facing surfaces of webs 56 each have at least one high density polyethylene (HDPE) grip strip 58. The grip strips 58 have a two-fold purpose. Firstly, they reside, as will be shown below, on the facing surfaces of the opening of the plastic bags or packages being manufactured. As such, they facilitate the gripping of those surfaces by the consumer opening the bag or package. Secondly, the grip strips 58 inhibit the sealing of the webs 56 to one another when they are being sealed to the plastic sheet material 10 of the bags or packages.

The mutually opposed surfaces of webs 56 each have at least one fusible rib 60 of a low-melting-temperature (high melt index) material, such as a high melt index polyethylene, ethylene vinyl acetate (EVA) or a similar material, so that the webs 56 may be joined to the plastic sheet material 10 at a temperature low enough to ensure that neither is damaged.

The male and female zipper profiles 44,46 may, of course, be extruded from polyethylene (PE).

The male and female zipper profiles 44,46 each include at least one zipper guiding rail 62 which rides in a groove 42 in inverted U-shaped channel 40 of zipper probe 34. For example, as illustrated in FIG. 4, one such zipper guiding rail 62 on each of the male and female profiles 44,46 may ride in a groove 42 on the roof of the inverted U-shaped channel 40. Those guiding rails 62 may be in a direct line with respective webs 56. In addition, the male and female profiles 44,46 may have zipper guiding rails 62 opposed to the male and female interlocking members 48,50 for riding in the grooves 42 on the sides of the inverted U-shaped channel 40. In any event, at least one zipper guiding rail 62 of this latter variety may be provided for engagement into a groove 42 in the side of the inverted U-shaped channel 40 for each of the male and female profiles 44,46 to prevent the zipper 36 from falling out of the zipper probe 34. Further, these latter zipper guiding rails 62 may assist a consumer in reclosing the zipper 36 on a bag or package.

Figure 5:
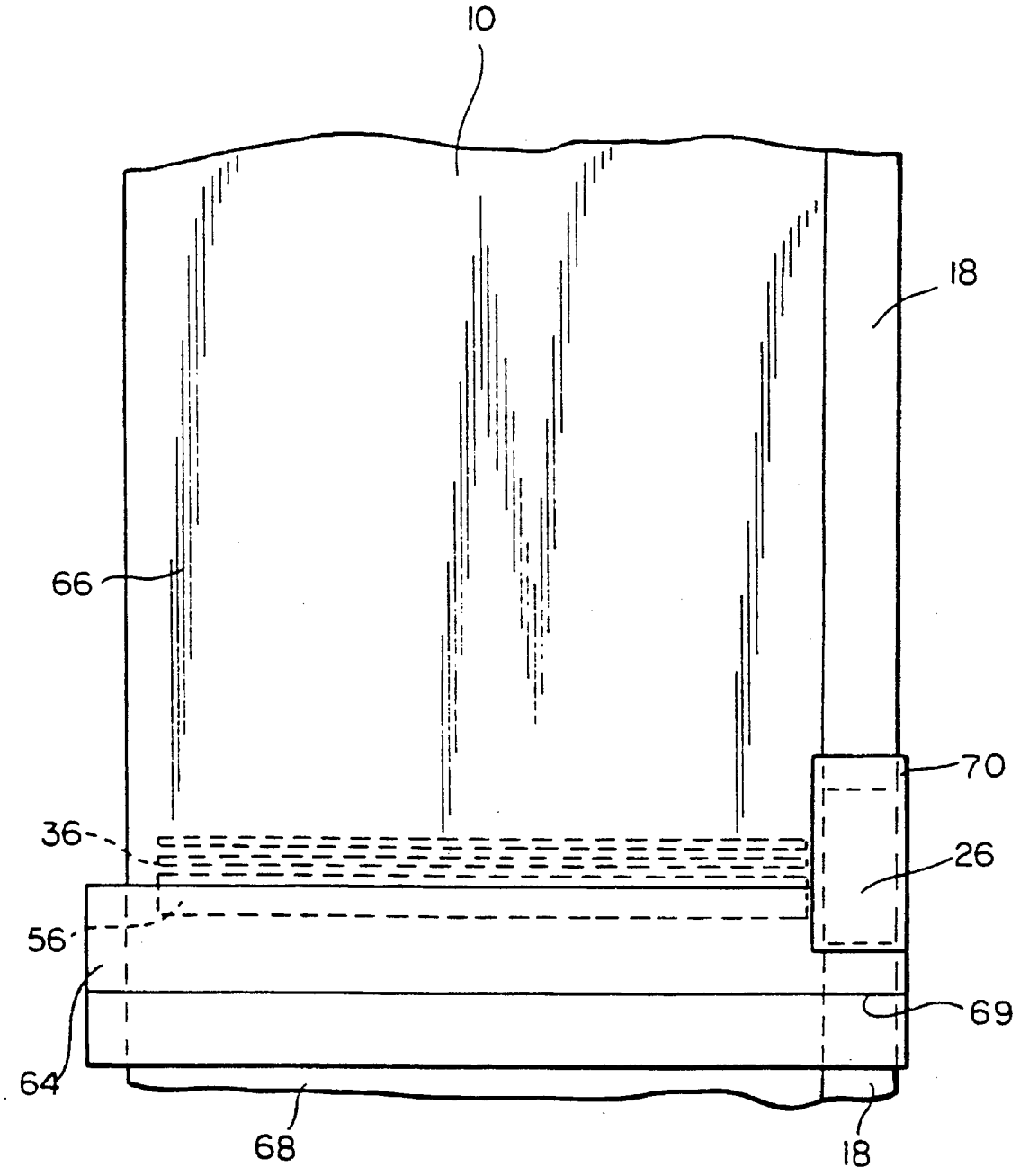
FIG. 5 shows the bonding of the zipper to the plastic sheet material, the sealing of the fin seal gap, and the sealing of the tops and bottoms of the packages made in accordance with the present invention.

Referring now to FIG. 5, following the insertion of the zipper probe 34 through the fin seal gap 26, cross seal jaws 64 seal the top of the bag or package 66 being made (in an upside-down orientation) as well as the bottom of the previous package 68. In other words, the lower end of the zipper 36 shown in the figures is on the upper edge of the finished packages. A knife 69 within cross seal jaws 64 separates the packages 66,68 after the seals are made. Cross seal jaws 64 are also indicated in FIGS. 2 and 3.

Cross seal jaws 64 also seal the webs 56 of the male and female zipper profiles 44,46 to the plastic sheet material 10. Upon closing the cross seal jaws 64 to start the sealing actions described above, zipper probe 34 is withdrawn through fin seal gap 26 and reloaded with zipper 36 for the next bag or package to be produced. A fin gap sealer 70 then seals the fin seal gap 26 to complete the manufacture of the package 66. The fin gap sealer 70 is also indicated in FIG. 3.

Figure 6:
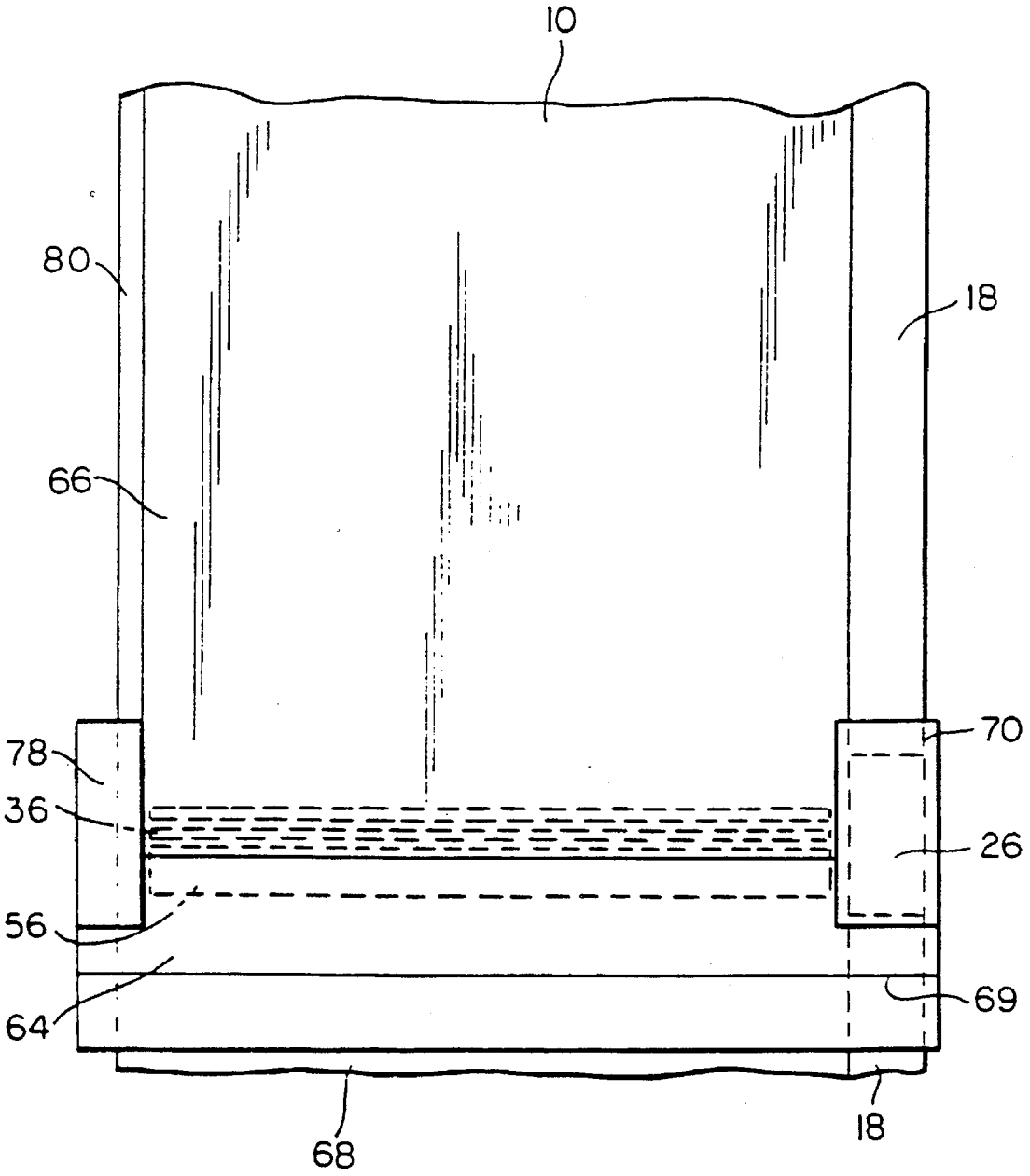
FIG. 6 shows a view similar to that presented in FIG. 5 with the addition of a further seal along the opposite longitudinal edge of the plastic sheet material.

FIG. 6 shows an alternate embodiment of the present invention wherein a second fin gap sealer 78 is provided on the opposite side of plastic sheet material 10 from fin 18 as a precaution against leaking packages. For aesthetic reasons, side portion 80 of plastic sheet material 10 may also be sealed in the same manner as is fin 18.

Figure 7:
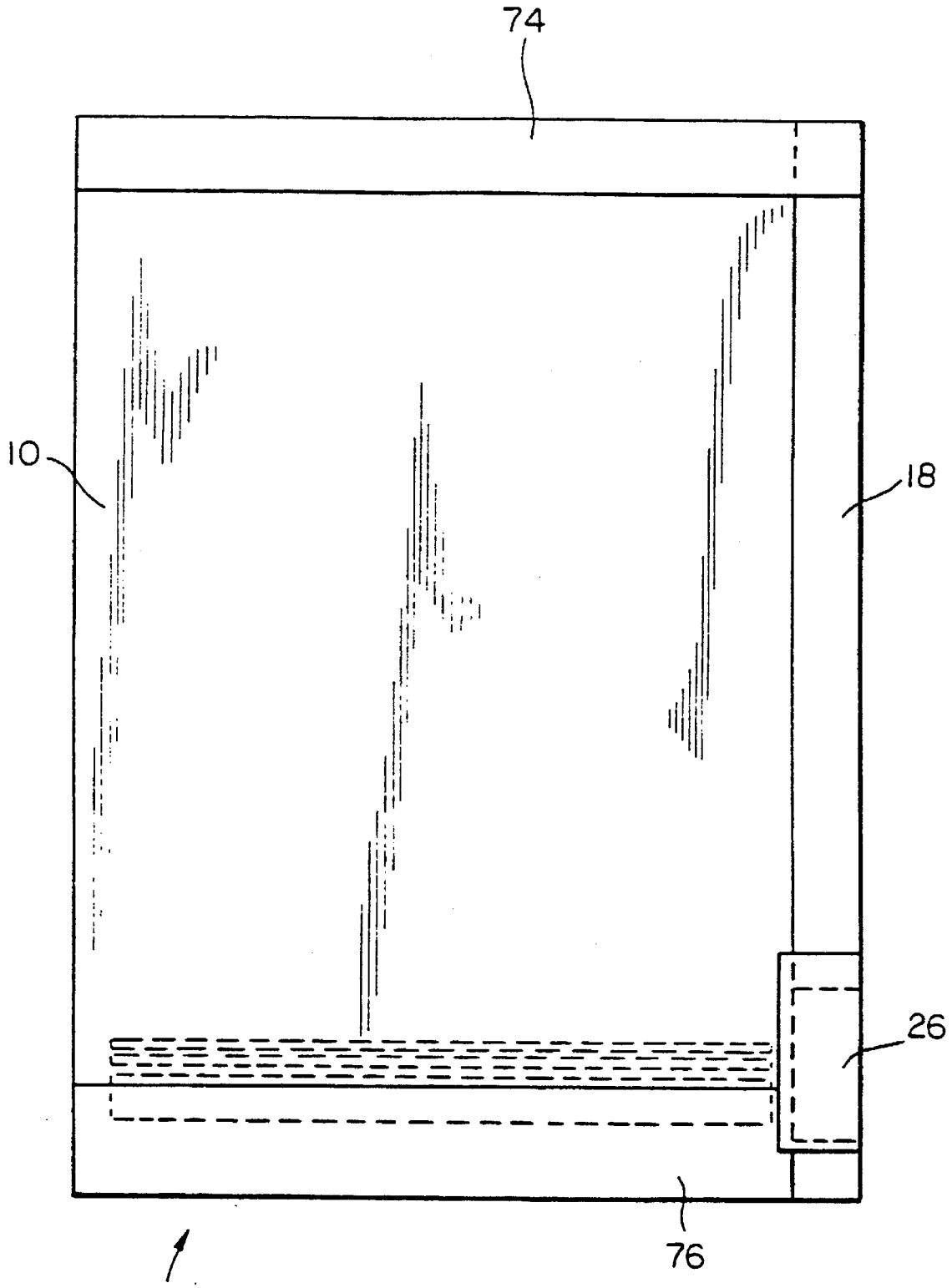
FIG. 7 shows a finished package made in accordance with the present invention.

A completed package 72 is shown in FIG. 7. For the sake of simplicity, it is shown devoid of any contents, although it should be understood that the packages are being produced during a process in which they are simultaneously being filled. Bottom 74 and top 76 are sealed by cross seal jaws 64, the bottom 74 being sealed during the production of the following package. The fin 18 is sealed by the fin sealing bars 20,22. An area slightly larger than the fin seal gap 26 is sealed by the fin gap sealer 70. It will be observed that the zipper 36 does not cross the entire width of the package 72.

Figure 8:
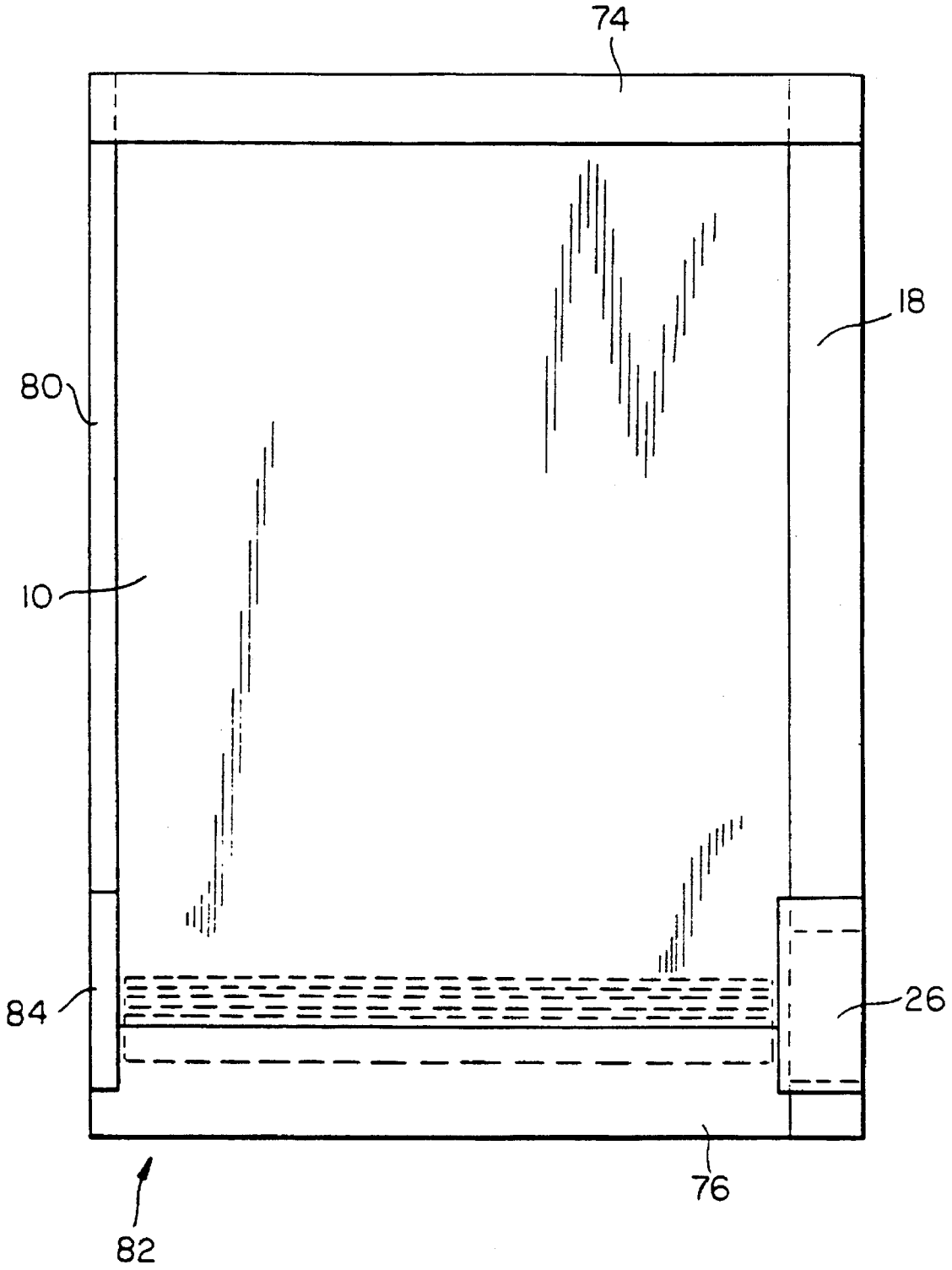
FIG. 8 shows a finished package made in accordance with the embodiment of the invention shown in FIG. 6.

FIG. 8 shows a completed package 82 made in accordance with the embodiment shown in FIG. 6. Area 84 is sealed by the second fin gap sealer 70, and side portion 80 is sealed to give the package 82 a more symmetrical appearance than package 72 in FIG. 7.

To summarize, the basic FFS machine cycle accordingly comprises the following steps:

a) directing a plastic sheet material toward and about a filling tube of an FFS machine to form a tube having a fin formed by the mutually contacting lateral edges thereof;

b) forming an interrupted fin seal having a gap of from 1½ to 2 inches in width;

c) opening the fin seal gap, for example, by a vacuum means below the fill tube;

d) inserting a loaded zipper probe through the fin seal gap and into the formed film tube;

e) closing the product stagers and dropping a preselected amount of the product thereinto;

f) closing cross sealing jaws onto the web portions of the zipper to seal the webs to the plastic sheet material, to seal the top of the package, and to seal the bottom of the previous package, where the packages are being manufactured in an upside-down configuration;

g) withdrawing and reloading the zipper probe;

h) closing the fin gap sealing jaws;

i) opening the product stagers to permit the preselected amount of product to drop into the tube;

j) advancing the plastic sheet material;

k) cutting off the previously manufactured package; and l) opening the cross sealing jaws and returning them to their starting position.

Modifications to the above would be obvious to those of ordinary skill in the art, but would not bring the invention so modified beyond the scope of the appended claims. For example, the plastic tube may be formed with an uninterrupted fin seal and a slit formed in the tube at a location offset from the fin. A gap may then be produced by applying vacuum cups to opposite sides of the slit and the zipper probe introduced through the gap thus formed. After the probe is removed, the gap would be sealed closed. By offsetting the slit by 90° from the fin a so-called "pillow" bag may be formed with the technology of the present invention.

What is claimed is:

1. An apparatus for the manufacture of plastic bags on a form, fill and seal machine which includes a longitudinally extending filling tube and a forming collar for guiding a plastic sheet material having lateral edges into the form of a tube having a longitudinally fin formed by said lateral edges about said filling tube, said apparatus comprising:

a first pair of longitudinal fin sealing bars and a second pair of longitudinal fin sealing bars, said first and second pairs of longitudinally fin sealing bars being longitudinally separated from one another by a transverse gap, so that, when said tube is sequentially advanced in increments equal to a longitudinal dimension of a package, a transverse fin seal gap will remain when the first and second sealing bars seal said fin;

means for opening said transverse fin seal gap, said means being at a first position downstream from said gap between said first and second pairs of fin sealing bars a distance equal to a whole number multiple of said longitudinal dimension of a package; and means for inserting a preselected length of zipper into said transverse gap of said tube, said means for inserting being at said first position with said means for opening said transverse fin seal gap.

2. An apparatus as claimed in claim 1 further comprising:

a pair of longitudinally moveable cross seal jaws at said first position for sealing said web of said zipper to said tube, for sealing an end of a package adjacent to said zipper, and for sealing an end of a previously manufactured package;

a knife for separating a package from a previously manufactured package;

means for moving said pair of longitudinally moveable cross seal jaws from said first position to a second position downstream a distance equal to a longitudinal dimension of a package as said tube is being advanced;

a transverse fin gap sealer on said cross seal jaws for sealing said transverse fin seal gap between said first and said second positions; and means for returning said pair of longitudinally moveable cross seal jaws from said second position upstream to said first position with said means for opening said transverse fin seal gap and said means for inserting said preselected length of zipper.

3. An apparatus as claimed in claim 1 wherein said means for opening said transverse fin seal gap is a vacuum means.

4. An apparatus as claimed in claim 3 wherein said vacuum means are vacuum cups.

5. An apparatus as claimed in claim 1 wherein said means for inserting a preselected length of zipper is a zipper probe.

6. An apparatus as claimed in claim 5 wherein said zipper probe is an elongated member having a channel for disposition of said zipper.

7. An apparatus as claimed in claim 6 wherein said channel includes at least one groove to guide said zipper.

8. An apparatus as claimed in claim 5 further comprising means for withdrawing said zipper probe from said tube.

* * * * *